US005312048A

United States Patent [19]

Steingass et al.

[11] Patent Number: 5,312,048

[45] Date of Patent: May 17, 1994

[54] REGULATING NOZZLE WITH ADJUSTABLE EFFECTIVE AREA BAFFLE

[75] Inventors: Robert W. Steingass; Stewart G. McMillan, both of Valparaiso, Ind.

[73] Assignee: Task Force Tips, Inc., Valparaiso, Ind.

[21] Appl. No.: 36,918

[22] Filed: Mar. 25, 1993

[51] Int. Cl.[5] ..... B05B 1/32

[52] U.S. Cl. ..... 239/441; 239/443; 239/452; 239/459; 239/570; 239/581.1; 137/599.2

[58] Field of Search ..... 239/453, 459, 460, 439, 239/441, 443, 452, 533.1, 570, 581.1, 107; 137/516, 599.2

[56] References Cited

U.S. PATENT DOCUMENTS

| | | | |
|---|---|---|---|
| 1,018,310 | 2/1912 | Frey | 239/453 |
| 3,539,112 | 11/1970 | Thompson . | |
| 3,684,192 | 8/1972 | McMillan . | |
| 3,863,844 | 2/1975 | McMillan . | |
| 3,904,125 | 9/1975 | Allenbaugh | 239/459 X |
| 3,948,285 | 4/1976 | Flynn . | |
| 4,172,559 | 10/1979 | Allenbaugh, Jr. | 239/453 |
| 4,252,278 | 2/1981 | McMillan . | |
| 4,289,277 | 9/1981 | Allenbaugh | 239/459 |
| 5,012,979 | 5/1991 | Williams | 239/581.1 X |

*Primary Examiner*—Andres Kashnikow

*Assistant Examiner*—William Grant

*Attorney, Agent, or Firm*—Marshall, O'Toole, Gerstein, Murray & Borun

[57] ABSTRACT

A nozzle including a tubular nozzle body forming a centrally located liquid flow path, the body having an inlet end and an outlet end. Mounted centrally in the body within the flow path is a pressure-regulating mechanism including an axially located dual-pressure baffle. The baffle is located at the outlet end and forms a nozzle gap with a throat surface of the body. During operation, a spring biases the baffle to close the gap and the liquid pressure on the baffle operates to open the gap. Adjustably mounted on the baffle is a shield which is movable relative to the baffle between a normal pressure position and a low pressure position. In the normal pressure position, the shield forms a gap size appropriate for a normal supply pressure. In the low pressure position, the shield forms a gap having an increased size appropriate for a supply pressure which is substantially less than the normal supply pressure. In addition to changing the gap size, adjustment of the shield also changes the effective area over which the water pressure acts on the baffle. Apparatus is provided for increasing the effective baffle area during operation in the low pressure position, whereby the water pressure further increases the size of the gap.

10 Claims, 12 Drawing Sheets

REGULATING NOZZLE WITH ADJUSTABLE EFFECTIVE AREA BAFFLE

FIELD AND BACKGROUND OF THE INVENTION

This invention relates generally to fluid nozzles, and more particularly to nozzles for use with fire fighting equipment of the type used by professional firefighters.

A common method of extinguishing fires is, of course, to apply a large quantity of water to the burning material or structure. The water is applied by projecting a stream from a nozzle and a hose connected to a water supply, and numerous nozzle designs have been used and described in prior art patents. One objective of nozzle designers is to regulate the water pressure at the nozzle outlet to achieve a substantially constant outlet pressure despite variations in the supply pressure. The commonly accepted outlet pressure is 100 psi.

U.S. Patents that describe automatic outlet pressure regulating mechanisms are, for example, No. 3,539,112; No. 3,684,192; No. 3,863,844; No. 3,948,285; and No. 4,252,278.

Generally, the regulating mechanisms include a spring-loaded baffle at the nozzle outlet. If the supply pressure increases, for example, the water pressure moves the baffle to increase the outlet flow area and thereby maintain the pressure substantially at the preset value. The opposite action occurs, of course, if the supply pressure drops.

Nozzles with pressure regulating mechanisms have operated satisfactorily under normal operating conditions. In an emergency situation, however, the supply pressure may drop to an abnormally low value. In this case, there is a danger that the water pressure on the baffle is not sufficient to hold it substantially open, and the outlet flow area may decrease to the point where an inadequate amount of water flows from the nozzle.

U.S. Pat. No. 4,252,278 shows a nozzle including a baffle 48 mounted on a post 50, and a compression spring 52 which urges the baffle 48 toward an insert 46. When using this nozzle, the baffle 48 would tend to move toward the insert 48 and reduce the flow area of the throat 44 if the supply pressure were to drop. This patent states that the nozzleman may adjust the position of the baffle 48 on the post 50. The baffle may be moved away from the insert 46 to flush out entrapped debris or when an inadequate supply pressure exists. Thereafter the nozzleman is supposed to return the baffle to its normal position. A shortcoming of the foregoing arrangement, when the baffle is moved when a low pressure condition exists, is that the flow area, or orifice, will likely be either too large or too small. While in theory the baffle 48 may be adjusted to an appropriate position, in practice a firefighter may not have sufficient presence of mind to do this in an emergency situation as when fighting a fire and the water supply pressure drops.

It is therefore a general object of the present invention to provide an improved nozzle having advantageous features.

SUMMARY OF THE INVENTION

A nozzle in accordance with this invention comprises a tubular nozzle body forming a centrally located liquid flow path, the body having an inlet end and an outlet end. Mounted centrally in said body within said flow path is a pressure-regulating mechanism including an axially located dual-pressure baffle. The baffle is located at said outlet end and forms a nozzle gap with a throat surface of the body. During operation, a spring biases the baffle to close the gap and the liquid pressure on the baffle operates to open the gap. Adjustably mounted on the baffle is a shield which is movable relative to the baffle between a normal pressure position and a low pressure position. In the normal pressure position, the shield forms a gap size appropriate for a normal supply pressure. In the low pressure position, the shield forms a gap having an increased size appropriate for a supply pressure which is substantially less than the normal supply pressure.

In addition to changing the gap size, adjustment of the shield also changes the effective area over which the water pressure acts on the baffle. Means is provided for increasing the effective baffle area during operation in the low pressure position, whereby the water pressure further increases the size of the gap.

BRIEF DESCRIPTION OF THE DRAWINGS

The foregoing and other objects and advantages of the present invention will become apparent from the following detailed description taken in conjunction with the accompanying figures of the drawings, wherein.

Detailed Description of the Drawings

Figure 1:
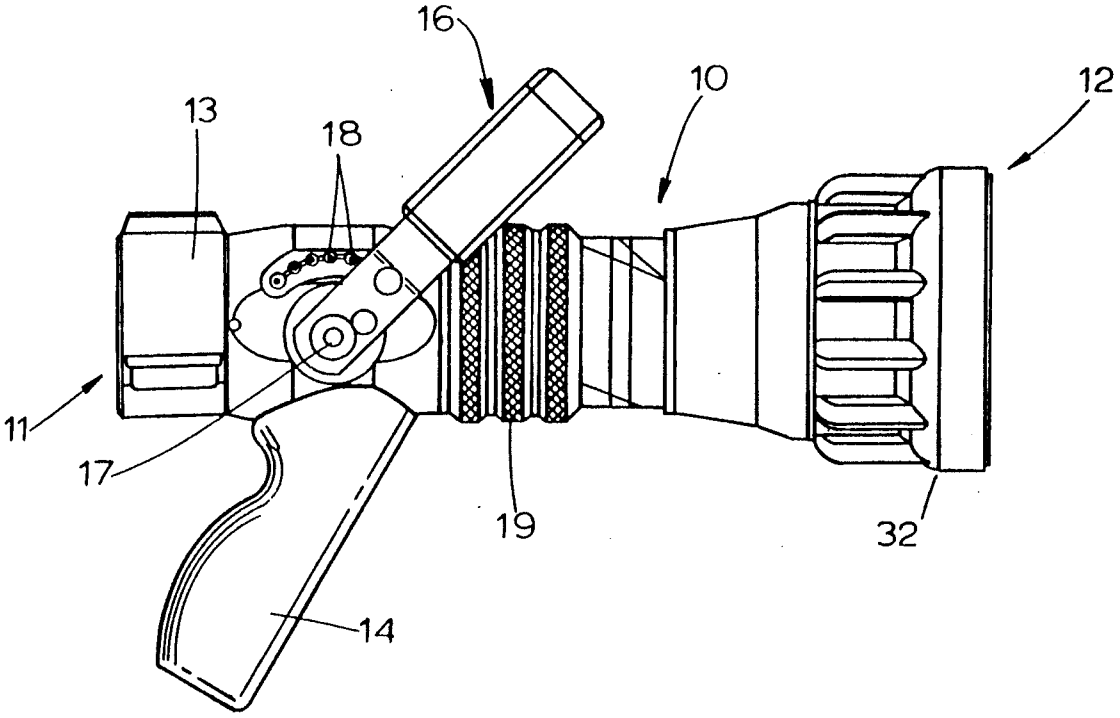
FIG. 1 is a view of a nozzle incorporating apparatus in accordance with this invention.

With reference first to FIG. 1, there is illustrated a firefighting nozzle including a tubular nozzle body 10 having a supply or liquid inlet end 11 and a liquid outlet end 12. At the supply end 11 is provided a coupling 13 for securing the nozzle to an end of a supply hose (not illustrated) in a conventional manner. A pistol grip 14 is formed on the underside of the body for use by a firefighter or nozzleman to hold and direct the nozzle. On the upperside of the body is provided a U-shaped handle 16 pivotably mounted on the body by pivot pins 17, and detents 18 cooperate with projections on the handle 16 to hold the handle in a position selected by the firefighter. The handle 16 is used by the firefighter to control the flow and/or cut off flow of the liquid.

The parts 13, 14 and 16 to 18 may be conventional in construction.

Figure 2:
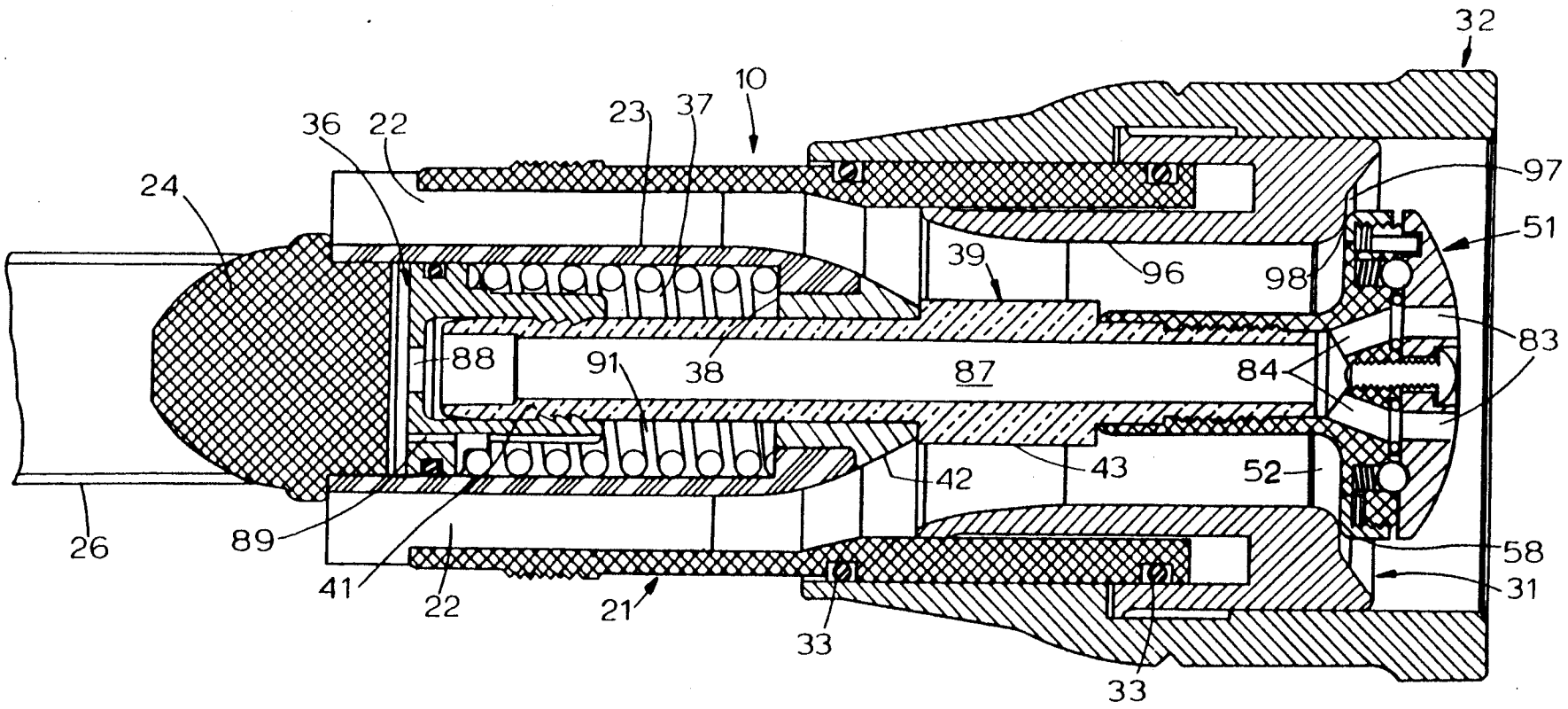
FIG. 2 is a sectional view of a portion of the nozzle, illustrating the operation thereof in a normal pressure mode and with no liquid flow.
Figure 2A:
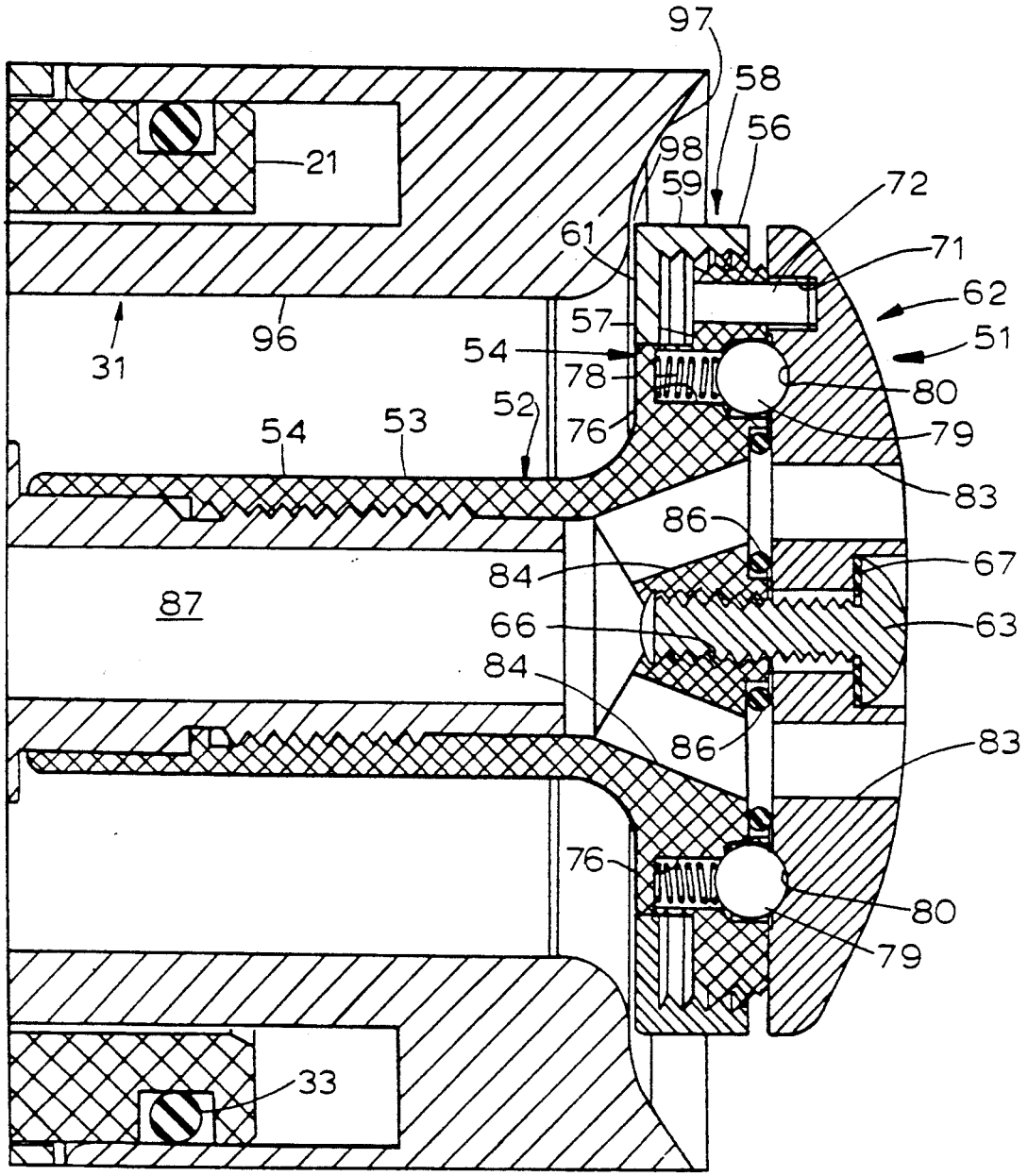
FIG. 2A is an enlarged fragmentary view of a portion of the structure shown in FIG. 2.
Figure 3:
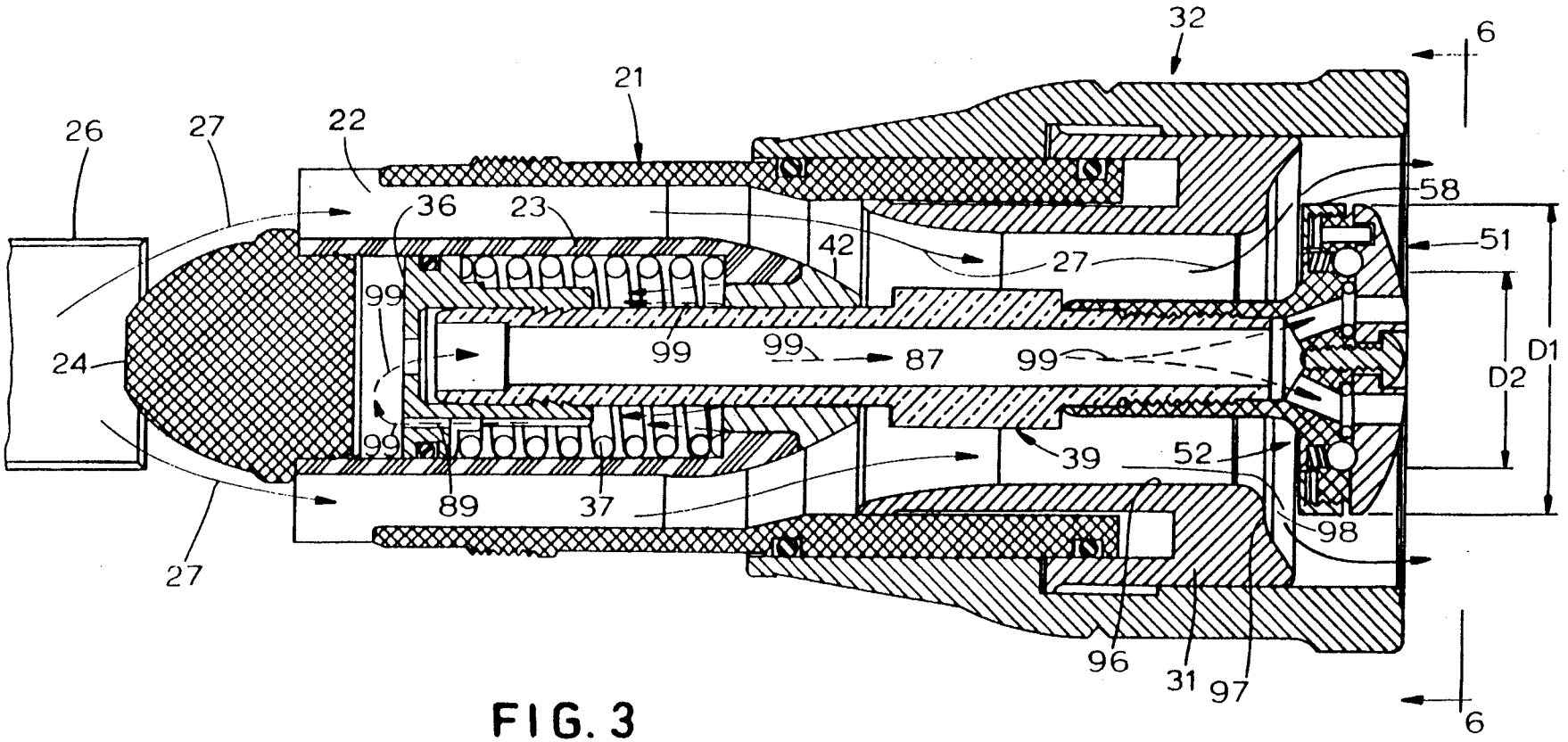
FIG. 3 is similar to FIG. 2 but illustrating the operation with liquid flow.

With specific reference to FIGS. 2, 2A and 3, the body 10 includes a tubular body member 21 which has the knurled sleeve 19 (not shown in FIGS. 2 and 3) threaded on it. Extending inwardly from the interior of the member 21 are formed a plurality of radial vanes 22, and the radially inner edges of the vanes 22 support a cylinder 23. A valve cone 24 is mounted on the upstream end (toward the left as seen in FIGS. 2 and 3) of the cylinder 23, the cone 24 cooperating with valve tube 26 to open or close the liquid flow through the nozzle. The tube 26 is connected to receive the liquid flow from the inlet end 11, and it is movable axially of the nozzle by moving the handle 16. When the tube 26 is in the closed position where the parts 24 and 26 engage as shown in FIG. 2, flow of liquid through the nozzle is blocked. When the tube 26 is in the open position where the parts 24 and 26 are separated as shown in FIG. 3, the liquid flows through the nozzle a indicated by the flow arrows 27.

Secured to the forward end of the body member 21 is a throat insert 31 which extends along the inner surface of the body member 21. Extending around the insert 31 and around the forward end of the body member 21 is a bumper 32. The members 31 and 32 are sealed to the outer surface of the member 21 by O-rings 33.

A piston 36 is mounted within the cylinder 23 for movement in the axial direction, and a compression spring 37 urges the piston 36 toward the left as seen in FIG. 2. The spring 37 is positioned between the piston 36 and a ledge 38 on the cylinder 23. A piston stem 39 has its left end 41 secured to the piston, and it extends forwardly or to the right out of the cylinder 23. A tubular guide 42 is attached to the right-hand end of the cylinder 23 and slidingly engages the stem 39, and thus guides the stem movement along the axis of the member 21 and the cylinder 23. The stem 39 includes an enlarged portion 43 which forms a stop and limits the movement of the stem 39 toward the left.

A pressure mode adjusting mechanism 51 is mounted on the forward or downstream end of the stem 39, adjacent the throat insert, and is best illustrated in FIGS. 2A and 8 to 11. The mechanism 51 includes a support part 52 having a tubular internally threaded portion 53 that is threadingly secured to the forward end of the stem as indicated at 54 in FIG. 2A. The forward end of the part 52 flairs radially outwardly and forms a radially enlarged circular baffle 54 at the outlet end of the nozzle. The outer periphery of the baffle 54 is threaded as indicated at 56 (FIG. 2A and 8), and the rearward side of the periphery is notched or recessed as indicated at 57.

An annular shield 58 has an axially extending portion 59 and a radially extending rearward portion 61. The portion 59 is internally threaded and engages the threads 56. The threads are preferably doubled or quadrupled (see FIG. 8) so that a relatively short angular movement of the shield on the baffle produces a substantial axial movement of the shield.

To rotate the shield 58 on the baffle 54, a knob 62 is rotatably fastened to the front side of the part 52 by a screw 63. The screw 63 extends through a centrally located hole 64 in the knob 62 and is threaded in a hole 66 on the axis of the part 52. A washer 67 enables the knob 62 to rotate relative to the head of the screw.

Figure 9:
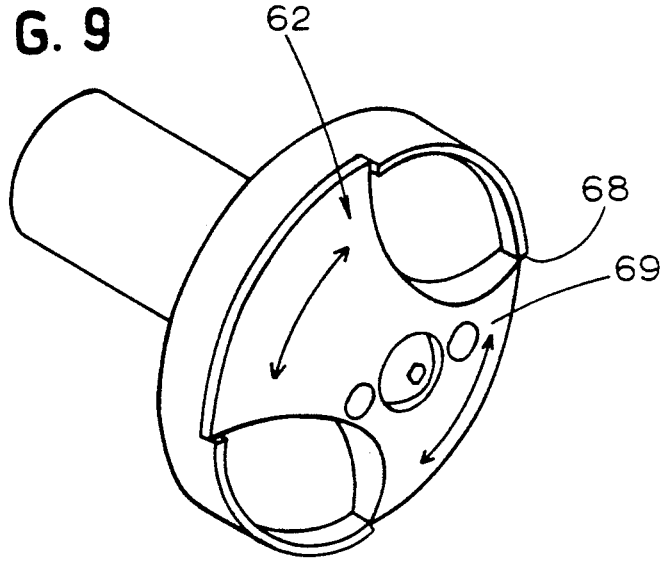
FIGS. 9 and 10 illustrate the settings for two modes of operation.
Figure 10:
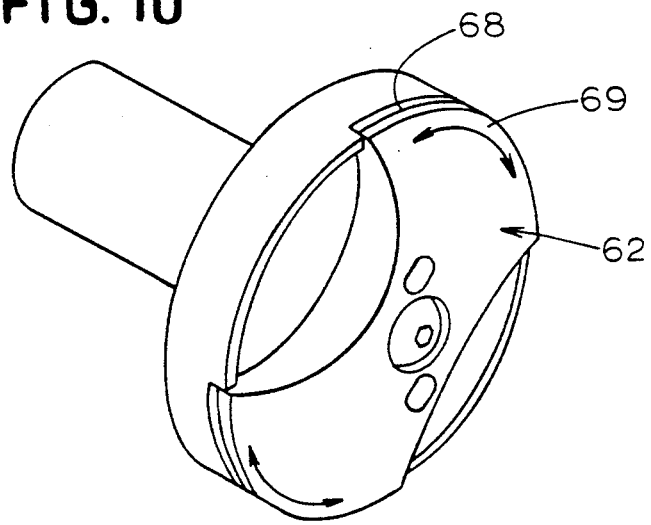
Figure 11:
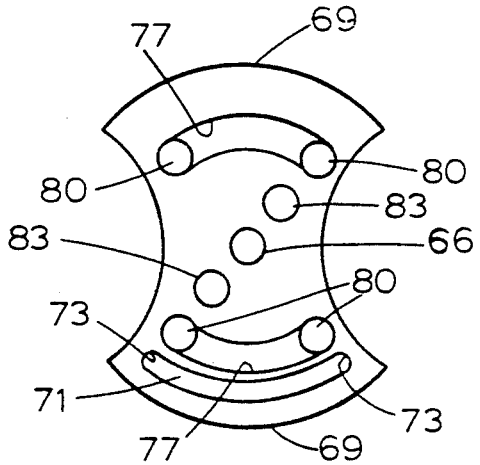
FIG. 11 illustrates a part of the nozzle.

The forward edge of the portion 59 of the shield 58 includes two diametrically opposed arcuate recesses or notches 68 which receive the radially outer ends 69 of the knob 62 as illustrated in FIGS. 9 and 10. Thus, a manually applied angular turning force on the knob 62 results in turning movement of the knob 62 and the shield 58 relative to the baffle 54. When the shield 58 rotates on the baffle 54, the shield 58 also moves axially due to the threads 56 but the knob 62 does not move axially. The ends 69 of the knob remain in the notches 68 despite the axial movement of the shield between a rearward position of the shield (FIGS. 2A and 10) and a forward position (FIG. 9).

To limit the amount of angular movement of the knob 62 on the baffle 54, an arcuate groove 71 (FIG. 11) is formed on the inner side of the knob and a pin 72 is fastened to the baffle 54 and extends into the groove 71. Thus the knob may be turned in either of two directions until the pin 72 strikes an end 73 of the groove 71, the two end positions producing, as will be described, a standard pressure mode of operation and a reduced pressure mode.

The knob 62 is releasibly held in either of the two end positions by a ball-in-detent arrangement. Two axially extending holes 76 (FIGS. 2A and 10) are formed in the baffle 54, and two arcuate grooves 77 are formed in the adjacent face of the knob 62, the grooves 77 being aligned with the holes 76. A compression spring 78 is seated in the bottom of each hole 76 and a ball 79 is positioned on the associated spring 78 and in engagement with the grooves 77. At the ends of the grooves 77 are formed slight depressions 80 which restrain movement of the balls 79 when the balls are seated in the depressions 80. Thus, the knob 62 is manually rotatable on the screw 63 either clockwise or counterclockwise up to either of the two end positions of the pin 72 in the groove 71, and at either of the selected end positions, the knob is retained therein by the balls 79 in the depressions 80.

The knob 62 has arcuate recessed portions 82 to enable a nozzleman to grip the knob with his/her fingers and turn the knob.

Further, the knob 62 has at least one, in this instance two, through holes 83 formed from front to back. The baffle also has through holes 84 (FIG. 2A) which are aligned with the knob holes 83 only when the knob is in the normal or standard pressure mode setting. The junctures of each pair of holes 83–84 is encircled by an O-ring 86 to make the juncture water tight.

As shown in FIGS. 2 and 2A, a hole 87 extends the length of the rod or stem 39. At its forward end, the hole 87 communicates with the holes 84, and at its rearward end, the hole 87 communicates with a hole 88 formed through the center of the piston 36. Outwardly of the stem 39, the piston 36 has an axially extending hole 89 formed through it, which connects the rearward side of the piston with the hollow space 91 around the spring 37 and between the stem 39 and the cylinder 23.

Figure 6:
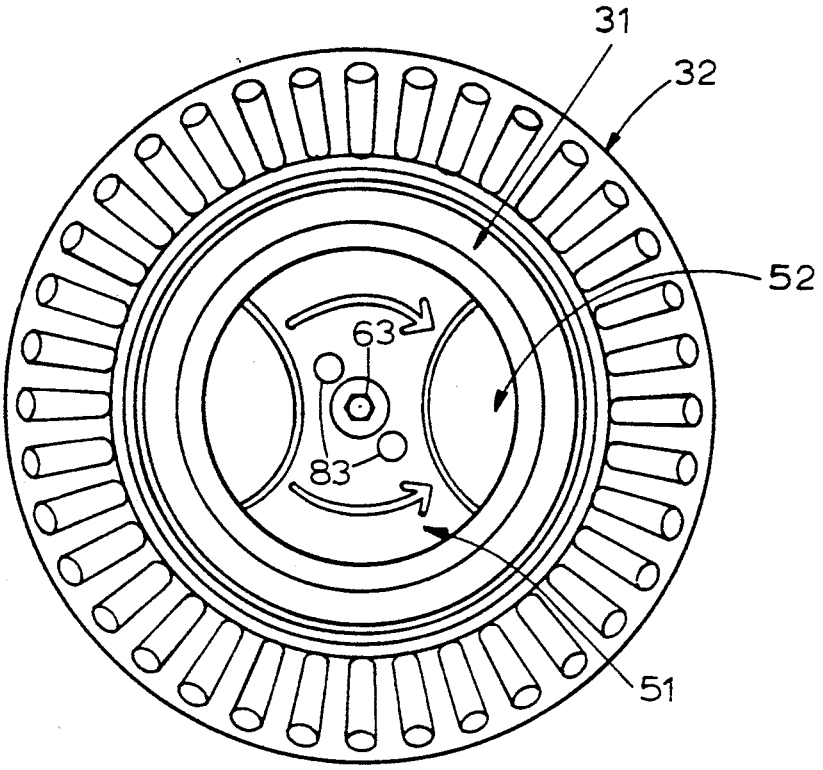
FIG. 6 is a view taken on the line 6—6 of FIG. 3.

Considering first the operation of the nozzle in the standard pressure mode setting, please refer to FIGS. 2, 2A and 3. With no water flowing through the nozzle (either because the supply is off or the tube 26 engages the cone 24), the spring 37 moves the piston 36 and the stem 39 to the maximum rearward position. The knob 62 is turned in the clockwise direction (FIG. 6), causing the holes 83 and 84 to line up and the shield 58 to shift to its rearwardmost position. As shown in FIGS. 2 and 2A, the throat insert 31 is shaped to form a nozzle throat and includes an axially extending narrowed portion 96 and a radially outwardly extending widened portion 97 at its forward end. The rearward side of the shield 58 extends closely adjacent the portion 97, there being a small gap or space 98 between the parts 58 and 97.

When water flows (the tube 26 is backed off from the cone 24 as shown in FIG. 3) through the nozzle as indicated by the flow arrows 27 at standard pressure, the water supply pressure on the rearward side of the baffle 52 and the shield 58 tends to move the baffle 52, the stem 39 and the piston 36 forwardly (toward the right) as seen in FIG. 3. Such movement is counterbalanced by the compression spring 37. The baffle 52 and the shield 58 move forwardly from the insert portion 97 causing the gap 98 size to increase. Variations in the water supply pressure cause the gap 98 size to vary such as to maintain the outlet water pressure substantially constant.

In addition to the water flow indicated by the arrows 27, some of the supply water also flows through narrow openings between the stem 39, the guide 42 and the cylinder 23, and into the space 91 around the spring 37, as indicated by the broken line flow arrows 99 in FIG. 3. There are small clearances between the parts 23, 39 and 42 to allow such flow, referred to herein as internal flow. This internal flow passes through the narrow passage 89 in the piston to the rearward side of the piston, and into the central passage 87 in the stem. The forward end of the passage 87 is connected to the outside of the nozzle by the holes 83 and 84, and consequently the passage is substantially at atmospheric pressure. The small clearances between parts 23, 39 and 42 are sized to have a substantially larger flow area than narrow passage 89, so that the pressure in void 91 is substantially equal to the supply pressure. The water pressure drops from supply pressure to substantially atmospheric pressure when passing through the narrow passage 89.

Since the interior 87 of the stem and the baffle 52 is substantially at atmospheric pressure, the water supply pressure acts only on the portion of the baffle 52 which is radially outside the piston 36. In other words, the pressure acts over the area between the diameters D1 and D2 in FIG. 3.

Figure 4:
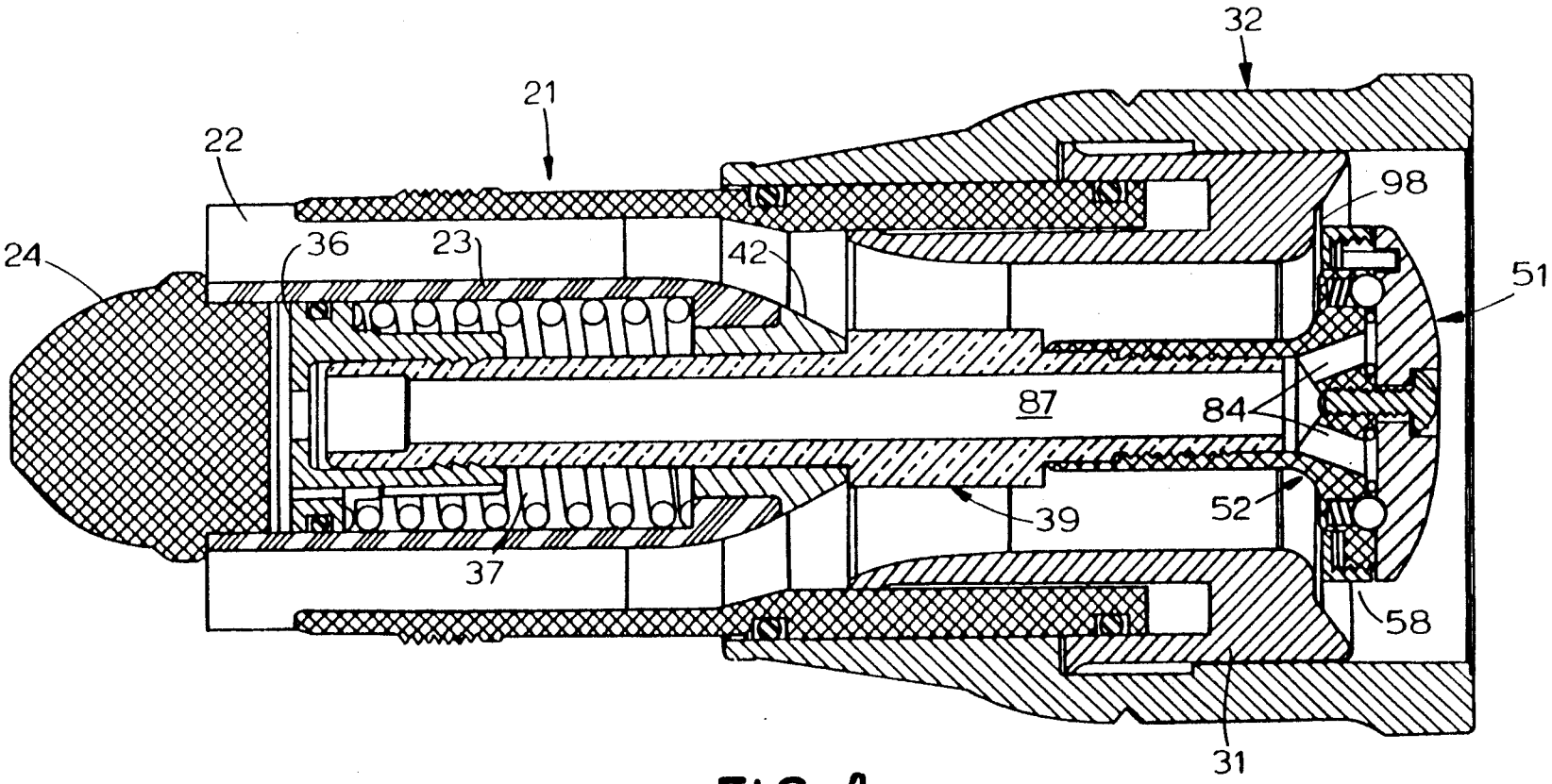
FIG. 4 is similar to FIG. 2 but illustrating the operation thereof in a low pressure mode and with no liquid flow.
Figure 4A:
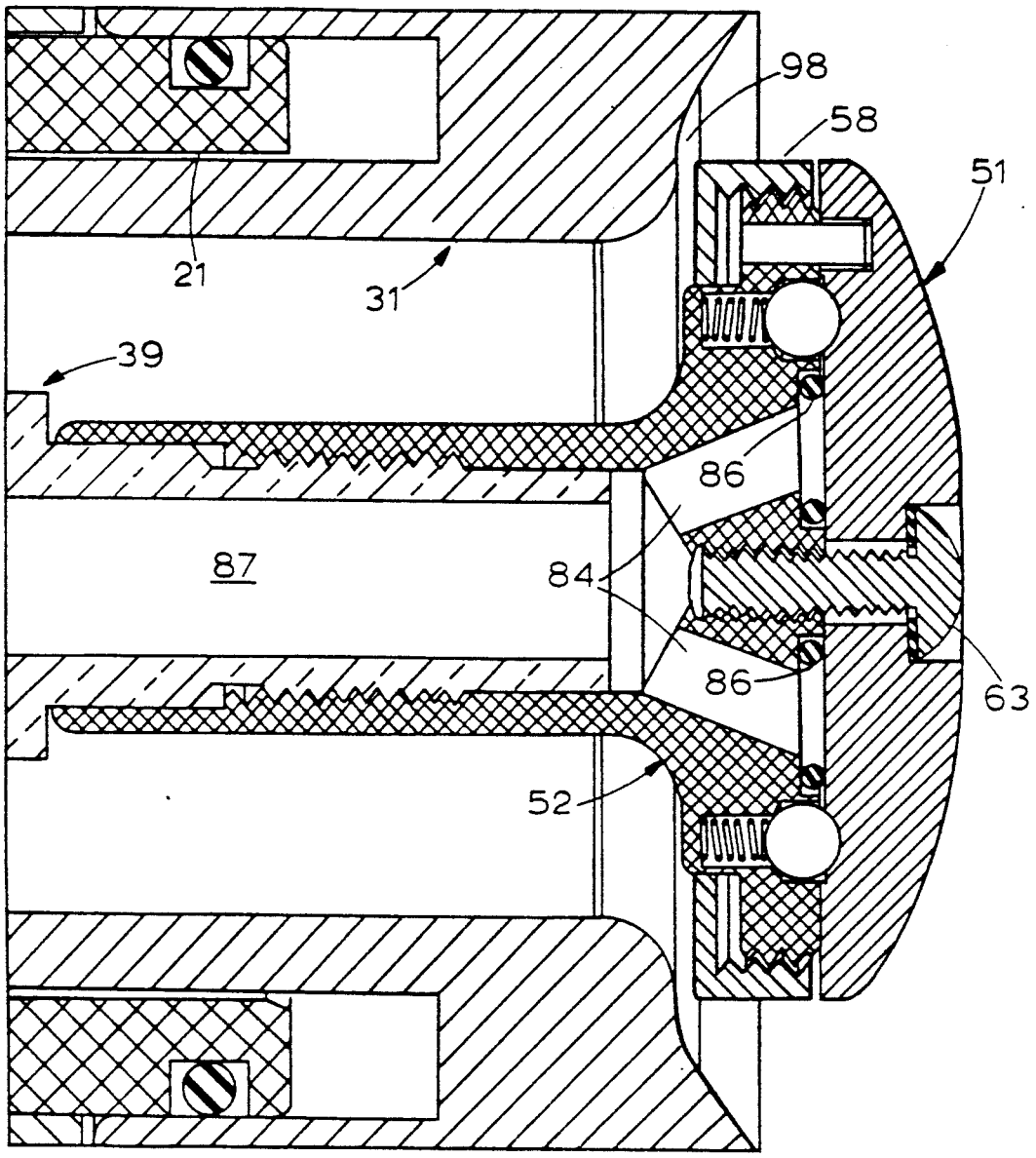
FIG. 4A is an enlarged fragmentary view of a portion of the structure shown in FIG. 4.
Figure 5:
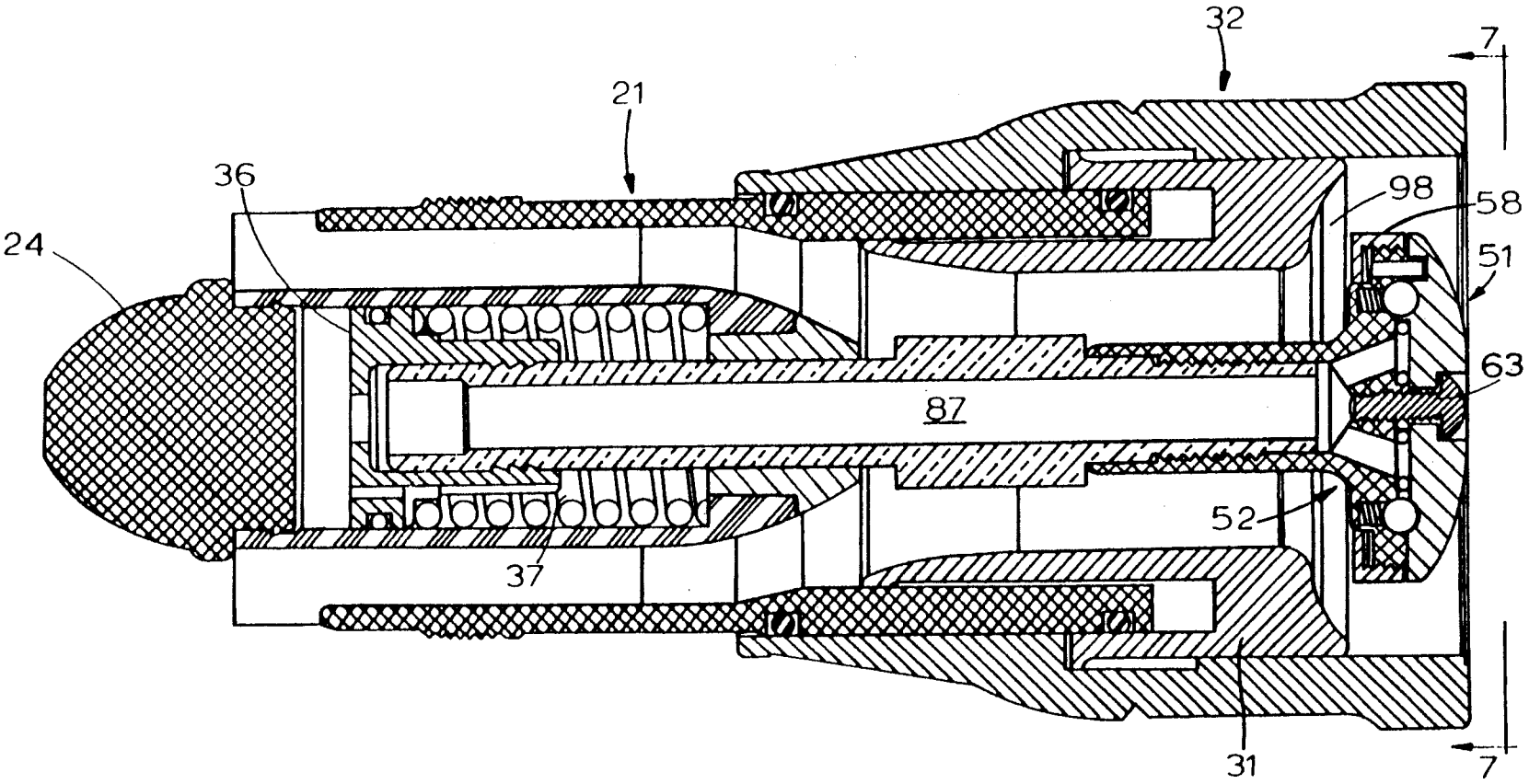
FIG. 5 is similar to FIG. 4 but illustrating the operation with liquid flow.
Figure 7:
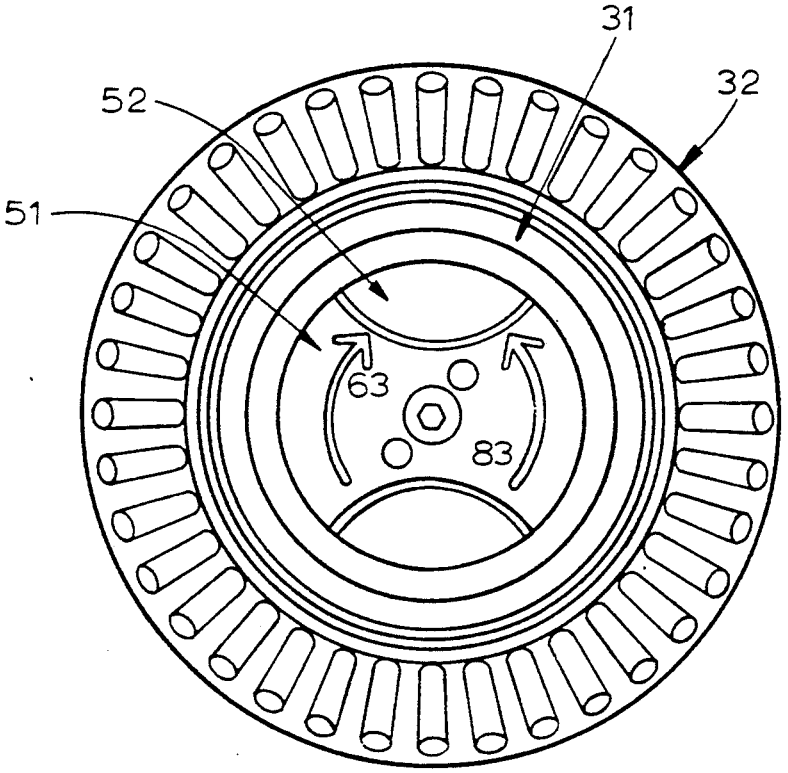
FIG. 7 is a view taken on the line 7—7 of FIG. 5.
Figure 8:
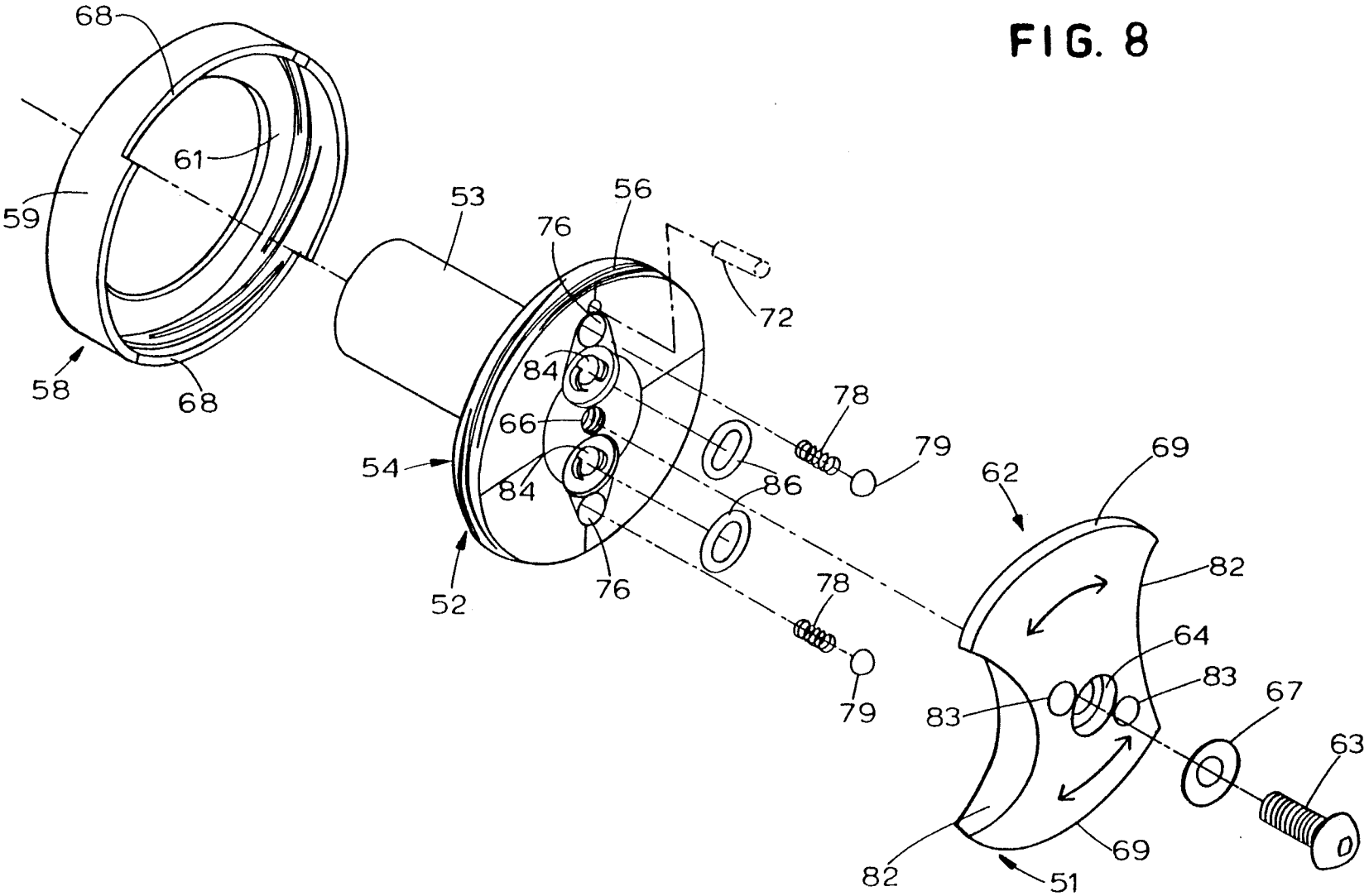
FIG. 8 is an exploded perspective view of a portion of the nozzle.

When the nozzleman becomes aware that the supply pressure has dropped to a substantially lower pressure, he/she momentarily turns off the water supply and then rotates the knob 51 counterclockwise (see FIG. 7) to the low pressure mode position shown in FIGS. 4, 4A and 5. This action does two things. First, the rotation of the knob 51 and the shield 58 causes the shield 58 to shift forwardly relative to the baffle 52 and to the throat portion 97 of the insert, thereby increasing the size of the gap 98. FIGS. 4 and 4A show the increased gap size without water flow. Second, the holes 83 are angularly shifted away from the holes 84, and the seals 86 form a liquid tight seal around the outlets of the holes 84.

When the water supply is again turned on, the water flows through the nozzle around the stem 39 and the baffle 54 and out through the gap 98. Water also flows through the clearances between the parts 23, 39 and 42 and the passage 89 to the center 87 of the stem 39, but since the knob 51 now blocks the holes 84 the water does not flow out of the center 87. Consequently the water in the center 87 is at substantially supply pressure, and thus the supply pressure acts over substantially the entire baffle diameter D1. Consequently the increased force acting on the baffle causes the gap 98 to be increased even further.

Figure 12:
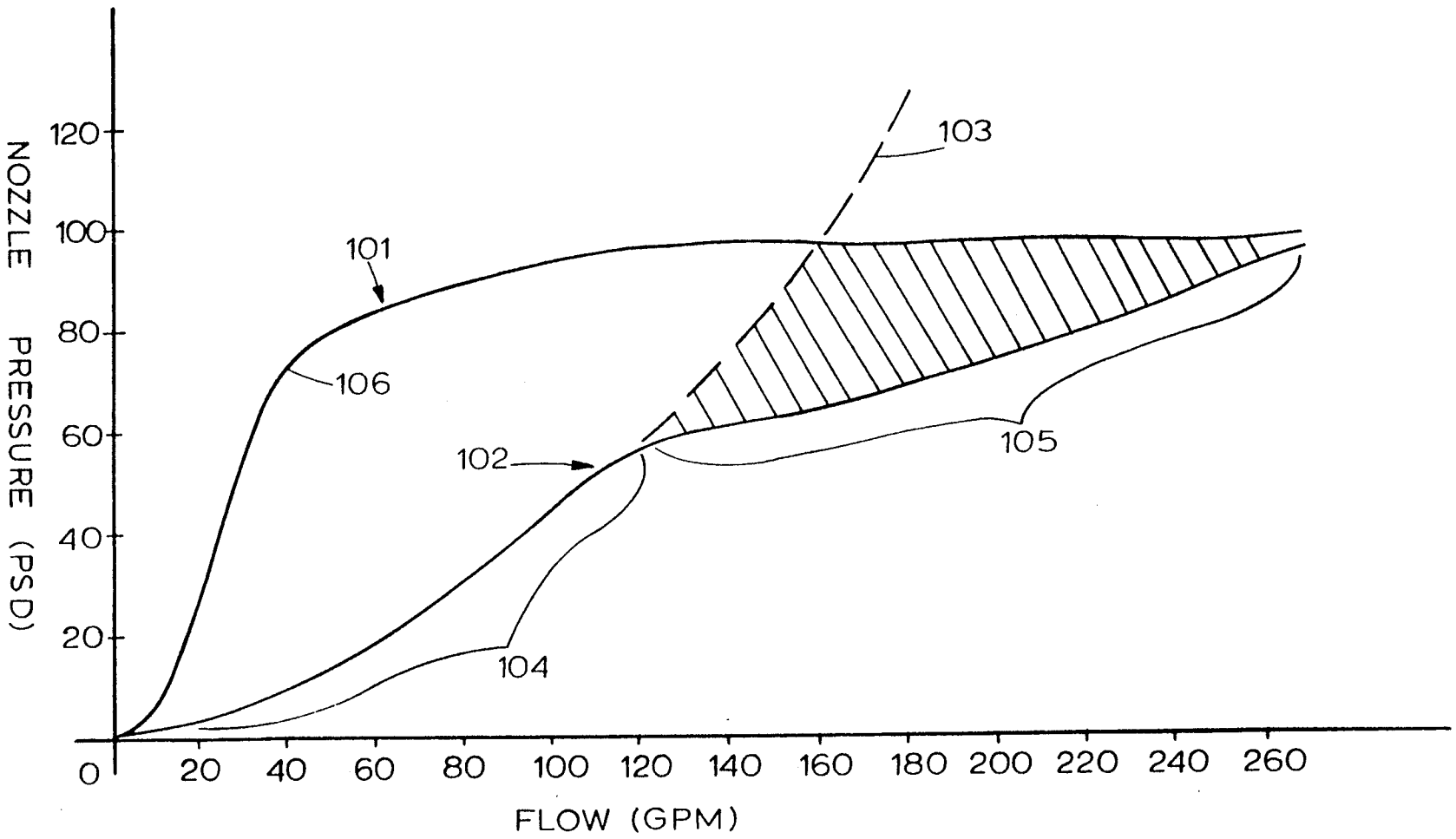
FIG. 12 is a graph illustrating the operation of the nozzle.

The combined changes due to the increase of the gap 98 and the increased area of water pressure acting on the baffle produces advantageous results. With reference to FIG. 12, the chart or graph shows the variations in nozzle pressure (psi) with liquid flow (gallons per minute). The curve 101 shows the nozzle operation when set for the normal pressure mode operation, and the curve 102 shows the operation in the low pressure mode operation. With reference to curve 101, at the knee 106 the supply pressure acting on the left side of the piston 36 is sufficiently high to compress the main spring 37 and thereby increase the size of the gap 98. The dashed line 103 shows the theoretical performance of a fixed orifice opening at the enlarged gap size. The portion 104 of the curve 102 shows the performance due to a fixed size enlarged gap, and the portion 105 shows the performance due to the internal stem pressure functioning to further increase the gap size. The hatched area shows the improved performance due to the further increase in gap size because of the internal pressure.

Figure 13:
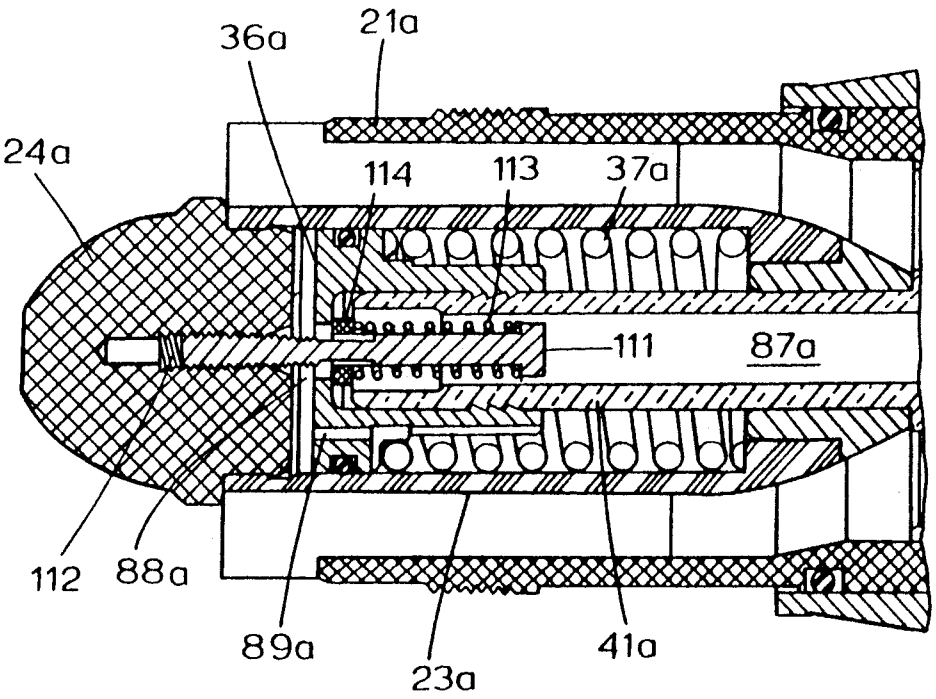
FIG. 13 illustrates an alternative construction of the nozzle.

FIG. 13 shows an alternative construction including a tubular body 21*a*, a cylinder 23*a*, a compression spring 37*a*, a piston 36*a* having a narrow passage 89*a* formed in it, a piston rod or stem 41*a* and a cone 24*a*. These parts may be identical with the corresponding parts of the previously described embodiment of the invention.

In addition, an elongated screw 111 extends from the central hole 87*a* of the stem 41*a*, through the hole 88*a* in the piston 36*a*, and is threaded in a hole 112 in the cone 24*a*. A compression spring 113 is mounted between the head of the screw 111 and a washer 114, and the washer 114 is mounted around the screw 111 between the spring 37*a* and the right side of the face of the piston 36*a*. As shown, the washer 114 covers the hole 88*a* in the piston 36*a* when the water pressure on the left side of the piston is at a relatively low value. When the water pressure on the left side of the piston 36*a* increases to a preset value, the pressure moves the washer 114 toward the right against the spring 113 and opens the hole 88*a*. Thus the spring 113 and the washer 114 modify the pressure on the left side of the piston 36*a*. The screw 111 may be adjusted further into or out of the hole 112 to modify the force of the spring 113 and thereby change the above mentioned preset value of the pressure.

It will be apparent from the foregoing that a novel and improved nozzle has been provided. The nozzle may be easily converted between a standard pressure mode and a low pressure mode, and it functions well in both modes of operation.

What is claimed is:

1. A nozzle for a stream of liquid, said nozzle comprising a tubular body having an inlet end operable to be attached to a liquid supply hose, the liquid having a supply pressure, said body further having an outlet end and a flow passage therethrough from said inlet end to said outlet end, and a pressure regulating mechanism mounted in said body in said flow passage and at said outlet end, said mechanism comprising a baffle mounted for movement on said body and in said flow stream and separated from said body by a gap, biasing means connected between said body and said baffle and acting to reduce the size of said gap, first adjustable means on one of said body and said baffle for changing the size of said gap, said baffle having an effective area on which said liquid pressure acts to vary size of said gap, and second adjustable means on said baffle for changing the size of said effective area.

2. A nozzle as set forth in claim 1, wherein said body includes a nozzle throat and said gap is formed between said baffle and said throat, and said first adjustable means comprises a shield which is mounted on said baffle for movement toward and away from said throat.

3. A nozzle as set forth in claim 1, wherein said second adjustable means comprises an interior area of said baffle, and selecting means for subjecting said interior area selectively between substantially atmospheric pressure and liquid pressure.

4. A nozzle as set forth in claim 1, wherein said first and second adjustable means are interconnected for simultaneous adjustment.

5. A nozzle as set forth in claim 4, wherein said first and second adjustable means are manually adjustable.

6. A nozzle for a stream of liquid, said nozzle comprising a tubular body having an inlet end operable to be attached to a liquid supply hose, the liquid having a supply pressure, said body further having an outlet end and a flow passage therethrough from said inlet end to said outlet end, and a pressure regulating mechanism mounted in said body in said flow passage and at said outlet end, said mechanism comprising a baffle mounted for movement on said body and in said flow stream and separated from said body by a gap, biasing means connected between said body and said baffle and acting to reduce the size of said gap, said baffle having an effective area on which said liquid pressure acts to vary the size of said gap, and adjustable means for changing the size of said effective area.

7. A nozzle as set forth in claim 6, wherein said pressure regulating mechanism further comprises a movable piston and said baffle being supported by said piston, said biasing means being operable to move said piston and said baffle, said adjustable means being operable to change said size of said effective area between a first size and a second size, in said first size said effective area being substantially equal to the area of said baffle, and in said second size said effective area being substantially equal to the area of said baffle minus the area of said piston.

8. A nozzle as set forth in claim 7, wherein said pressure regulating mechanism further includes a cylinder fastened to said body, said piston having first and second sides and being movable in said cylinder, and first passage means in said cylinder for subjecting said first side of said piston to substantially said supply pressure, and second passage means for subjecting said second side of said piston selectively between substantially said supply pressure and substantially atmospheric pressure depending on the setting of said adjustable means.

9. A nozzle as set forth in claim 8, wherein said adjustable means comprises a manually adjustable knob mounted on said baffle for opening and closing said second passage means.

10. A nozzle as set forth in claim 9, and further including a movable shield mounted on said baffle for changing the size of said gap, and said knob further being connected to move said shield.

* * * * *